US005138750A

United States Patent [19]

Gundlach et al.

[11] Patent Number: 5,138,750

[45] Date of Patent: Aug. 18, 1992

[54] ZIPPER FOR RECLOSABLE THERMOPLASTIC BAG

[75] Inventors: Douglas P. Gundlach; Michael J. Banco; Larry R. Erickson, all of Midland, Mich.; Marvin J. Kreh, Chapin, S.C.; William A. Kirksey, Midland, Mich.; William E. LeBoeuf, Midland, Mich.; Kevin J. Wagers, Midland, Mich.; John O. McCree, Saginaw, Mich.; Brian C. Dais; José Porchia, both of Midland, Mich.

[73] Assignee: Dowbrands L.P., Indianapolis, Ind.

[21] Appl. No.: 699,045

[22] Filed: May 13, 1991

[51] Int. Cl.[5] ..... A44B 19/00; B65D 33/00

[52] U.S. Cl. ..... 24/587; 24/403; 383/63

[58] Field of Search ..... 24/587, 576, 389, 403, 24/390, 715.3, 453, 662, 462; 283/63

[56] References Cited

U.S. PATENT DOCUMENTS

| | | | |
|---|---|---|---|
| 1,963,813 | 6/1934 | Van Voorhis | 24/715.3 |
| 2,091,617 | 8/1937 | Sundback | 24/403 |
| 2,557,163 | 6/1951 | Williams | 24/389 |
| 3,371,696 | 3/1968 | Ausnit . | |
| 3,440,696 | 4/1969 | Staller . | |
| 4,502,190 | 3/1985 | Inamura | 24/403 |
| 4,796,300 | 1/1989 | Branson | 24/587 |
| 4,821,381 | 4/1989 | Kaneko et al. | 24/453 |
| 4,854,017 | 8/1989 | Kamp | 24/587 |
| 4,941,238 | 7/1990 | Clark | 24/587 |

*Primary Examiner*—Victor N. Sakran

[57] ABSTRACT

A zipper closure for a reclosable thermoplastic bag includes two opposing interlockable rib and groove profiles, wherein at least a part of one or both of the profiles is divided into segments of materials having different elastic moduli. The zipper provides an audibly and/or tactilely perceptible indication of proper interlocking of the profiles.

7 Claims, 3 Drawing Sheets

ZIPPER FOR RECLOSABLE THERMOPLASTIC BAG

BACKGROUND OF THE INVENTION

The present invention relates to reclosable thermoplastic bags and to the mechanisms employed for closing such bags. More particularly, the invention relates to reclosable thermoplastic bags having zipper-type closures.

Reclosable thermoplastic bags with zipper-type closures have come into widespread use. The problem addressed by the present invention pertains to the determination or perception of whether or not the zipper of a reclosable plastic bag is properly closed or "zipped". Such a determination is often difficult save with a close visual inspection of the zipper.

One known way of making the determination easier is to use a zipper which provides a color change when the zipper is properly zipped. Different colors are utilized in each of the opposing zipper profiles to produce a third distinct color when the profiles are interlocked. Zippers utilizing such a color change are seen in U.S. Pat. Nos. 4,186,786 and 4,285,105. One disadvantage of using such a color change is that it may occur when the opposing zipper profiles are closely overlapped instead of only when the profiles are properly interlocked.

Commonly-assigned copending U.S. Ser. No. 07/531,951, filed on Jun. 1, 1990, solves the aforementioned problem and overcomes the deficiencies of the known art by providing a zipper for a reclosable thermoplastic bag that closes with a vibratory or bumpy feel and/or produces an audible clicking sound along its length when being closed, so that the fact of closure can be confirmed preferably both by sound and feel in addition to, or to the exclusion of, the close visual inspection required with previous zipper structures. Several embodiments of suitable zippers are described, with each of the embodiments having a part of a rib or groove profile which is structurally discontinuous in some fashion along its length.

SUMMARY OF THE INVENTION

The present invention also provides a zipper for a reclosable thermoplastic bag that closes with a vibratory or bumpy feel and/or produces an audible clicking sound along its length when being closed, but which does so in a substantially different way than the zippers of copending U.S. Ser. No. 07/531,951.

Rather than employing rib and groove profiles having differently-shaped segments along their lengths, as in copending U.S. Ser. No. 07/931,531, the zipper of the present invention comprises two opposing rib and groove profiles of a conventional, longitudinally consistent and continuous nature. The zipper of the present invention differs from conventional zippers, however, in that one or both of the profiles is or are comprised in essence of segments of different materials having different elastic moduli, with the segments in the profiles being arranged to produce an audibly and/or tactilely perceptible difference in the force required to close adjacent and preferably alternating portions of the zipper. These differences between adjacent portions can be adjusted, as by a selection of the materials for these portions or by a particular arrangement of the segments in the profiles, to provide a certain feel or sound as the zipper is progressively zipped.

DETAILED DESCRIPTION OF THE DEPICTED EMBODIMENT

Figure 1:
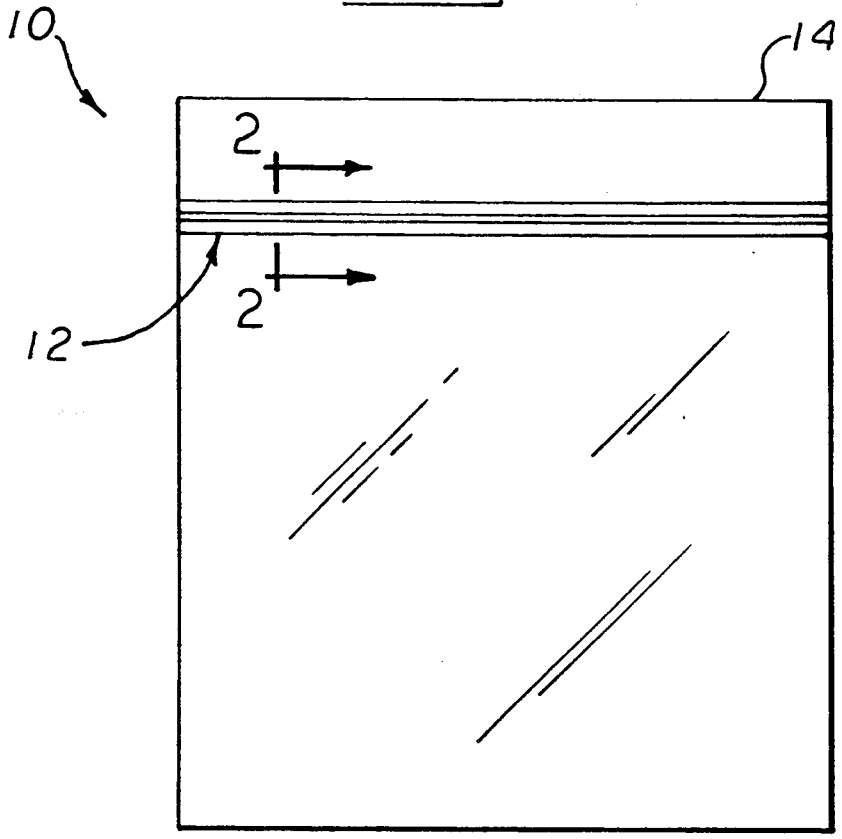
FIG. 1 is a front elevational view of a reclosable thermoplastic bag having a zipper in accordance with the present invention.
Figure 2:
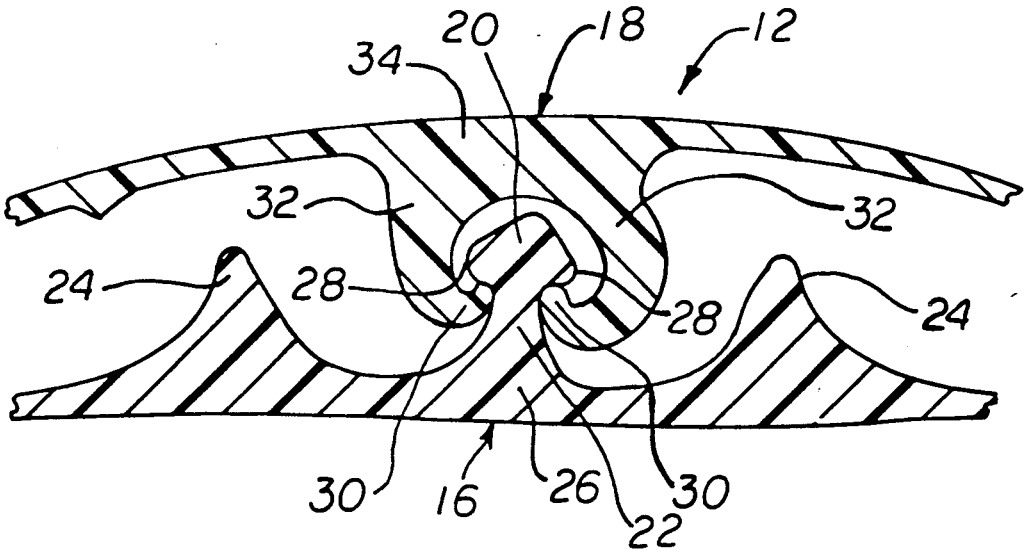
FIG. 2 is an enlarged cross-sectional view of one embodiment of the zipper in FIG. 1, taken along line 2—2 of FIG. 1 and showing a zipper having a conventional cross-sectional configuration.

Referring now to the drawings, FIG. 1 depicts a reclosable thermoplastic bag 10 having a zipper 12 about an opening 14 of the bag 10. FIG. 2 shows the zipper 12 in cross-section, while FIGS. 3–5 relate to embodiments of the zipper 12 wherein one (FIGS. 3 and 4) or both (FIG. 5) of the rib and groove profiles of the zipper are segmented with materials of different elastic moduli.

Figure 3:
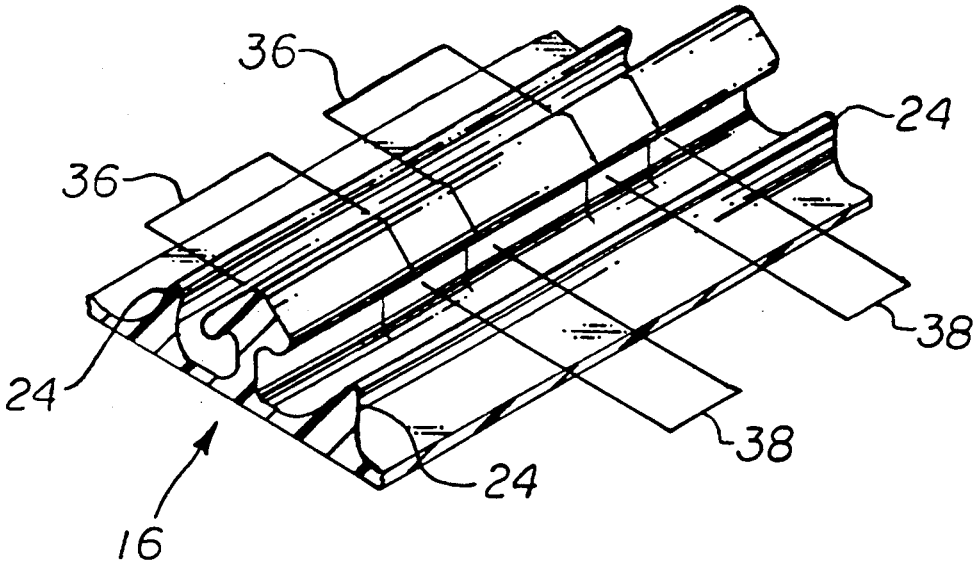
FIG. 3 is an enlarged fragmentary view partly in section of a profile in a first embodiment of the zipper of FIG. 2.
Figure 4:
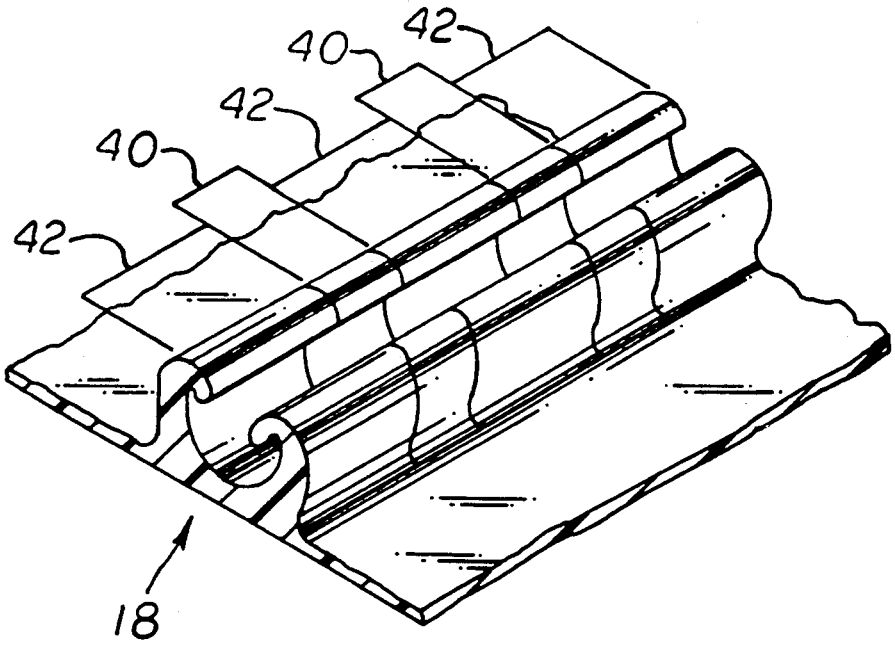
FIG. 4 is an enlarged fragmentary view partly in section of a profile in a second embodiment of the zipper of FIG. 2.
Figure 5:
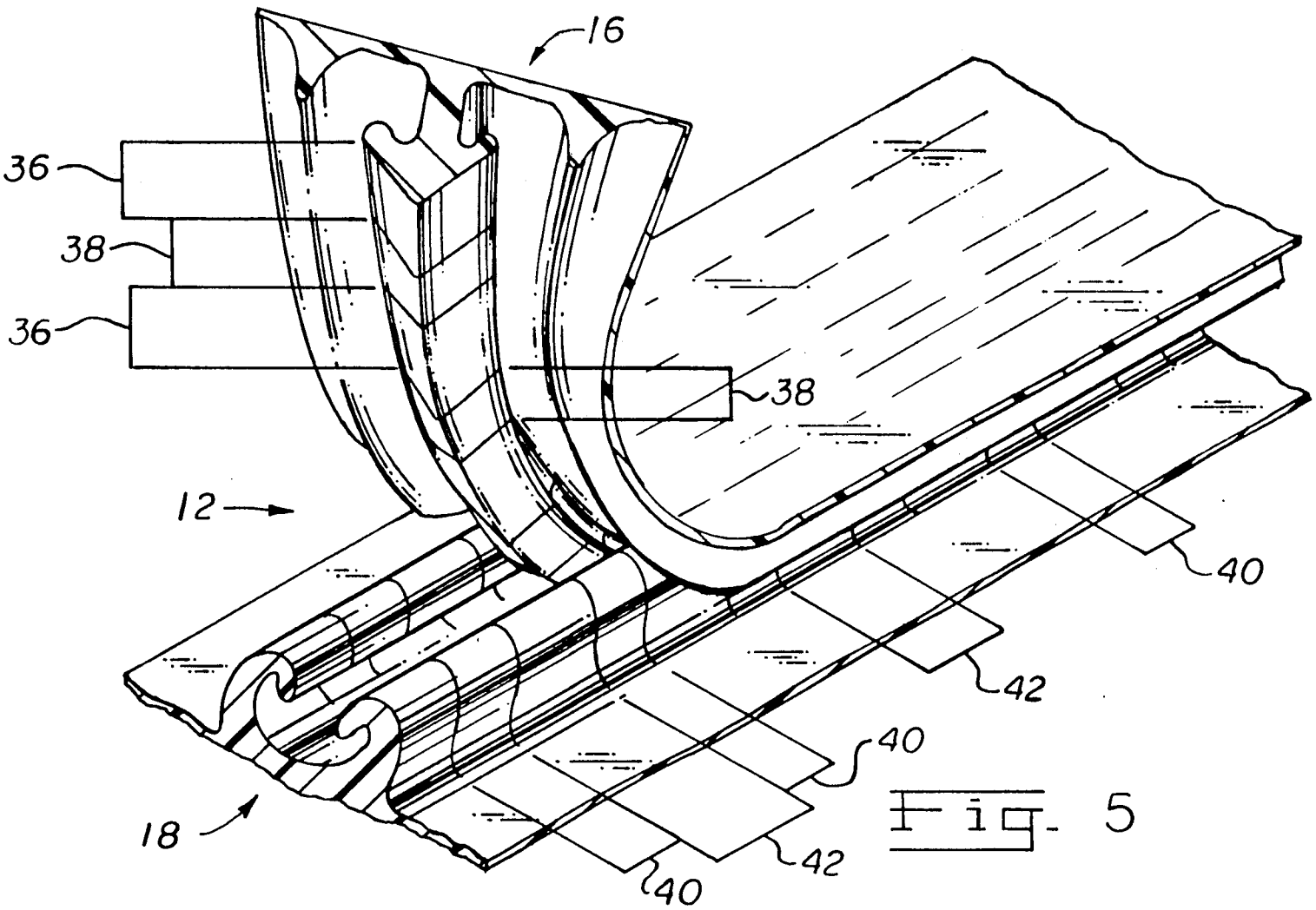
FIG. 5 is an enlarged fragmentary view partly in section of a third embodiment of the zipper of FIG. 2.

The embodiments of FIGS. 3–5 each have a conventional cross-sectional rib and groove profile configuration. In this configuration, shown in FIG. 2, the zipper 12 comprises a longitudinally extending rib profile 16 and an opposing longitudinally extending groove profile 18 which is interlockable with the rib profile 16. Rib profile 16 defines a bulbous head 20, a stem 22 and optionally, one or more ribs 24 adjacent the stem 22. The stem 22 and ribs 24 extend from a common base portion 26, with stem 22 defining head 20 at its free end. Head 20 includes oppositely disposed outwardly extending hooks 28 which interlock with corresponding hooks 30 of groove profile 18. The hooks 30 are defined at the free ends of groove arms 32, the groove arms 32 with a base portion 34 forming the generally U-shaped groove profile 18.

The groove profile 18 (not shown) in the first embodiment of FIG. 3 is formed of a single material. In contrast, the rib profile 16 is comprised of alternating first and second segments 36 and 38, respectively. These segments 36 and 38 are essentially comprised of materials having different elastic moduli, so that the interlocking of successive segments 36 and 38 with corresponding opposing portions of the groove profile 18 requires the application of different closure forces.

A second embodiment of zipper 12 is shown in FIG. 4. In this alternate embodiment, a zipper 12 is comprised again of the two opposing, longitudinally extending and interlockable rib and groove profiles 16 and 18, respectively, with one of the profiles being comprised of segments of materials with different elastic moduli while the opposing profile is constructed from a single material with a single elastic modulus. Whereas in FIG. 3 the rib profile 16 is segmented and the groove profile 18 formed a single material, in the alternate embodiment of FIG. 4 the groove profile 18 is divided into segments 40 and 42 and the rib profile 16 (not shown) is of a single material. The materials in segments 40 and 42 have different elastic moduli and thus require different closure forces when interlocked with the rib profile 16.

A third embodiment of the zipper 12 is shown in FIG. 5 and utilizes the segmented rib and groove profiles 16 and 18 shown in FIGS. 3 and 4, respectively, wherein opposing, interlocking segments of the opposing rib and groove profile are preferably coextensive. Most preferably, the segments 36 and 38 of the rib profile 16 and the segments 40 and 42 of the groove profile 18 will be arranged and constituted so that segments 36 and 42 will interlock over their common length with a given closure force, with segments 38 and 40 interlocking over their common length but with a different closure force.

It will be appreciated with respect to the third embodiment that if high modulus segments in one profile are paired with high modulus segments in the opposing profile and low modulus with low, then this arrangement should produce the most noticeable bumpy feel and/or clicking sound for this embodiment. It will also be appreciated, however, that the interlocking of the paired high modulus segments may require an undesirably high closure force. Preferably, then, the embodiments of FIGS. 3-5 will be designed in terms of the materials selection and arrangement of the various segments therein so that a clear tactile and/or audible indication of closure is provided, without at the same time requiring unduly large closure forces for any of the segments.

It is considered that the embodiments of the zipper 12 shown in FIGS. 3-5 may be made by an apparatus and by a method similar to those associated with "intermittent encapsulated coextrusion". Intermittent encapsulated coextrusion is a commercially available process package developed by Killion Extruders, Inc., Cedar Grove, N. J., and involves the use of a transposition valve which enables the composition of an extrudate to be changed in the machine direction as well as the transverse direction.

In the embodiments of FIGS. 3-5 the transposition valve would operate to intermittently valve molten portions of a high modulus material into a stream of low modulus material prior to the stream's extrusion through a rib or groove profile plate, while at the same time moving corresponding portions of the low modulus material into a stream of the high modulus material. The resulting profile segments in essence comprise a material of a given modulus encapsulated within a thin skin of the second material, so that the segments are not entirely of a particular high or low modulus material. It is considered, however, that the encapsulated material can be made to extend into the interlocking hook portions of a given rib or groove profile and the surrounding skin layer made sufficiently thin, so that on closure the segment of the profile behaves essentially as if made entirely of the encapsulated material.

The zippers 12 may be otherwise made and conventionally incorporated into reclosable thermoplastic bags of the type shown in FIG. 1 by a number of known integral and non-integral or post-applied zipper processes.

While several embodiments have been particularly described herein, it will be appreciated that a number of other embodiments are possible and could be employed without departing in scope or spirit from the present invention, as more particularly defined by the claims which follow.

What is claimed is:

1. A zipper closure for a reclosable thermoplastic bag, comprising two opposing, longitudinally-extending and interlockable rib and groove profiles, wherein a part of one or both of the profiles is divided into segments of materials having different elastic moduli interlockable with a portion of the opposing profile, said interlockable profiles being substantially free of interdigitation with one another, the zipper producing an auditably or tactically perceptible difference in the force required to close adjacent portions of the zipper.

2. A zipper as defined in claim 1, wherein the segments are arranged so as to produce both an audibly and a tactilely perceptible difference in the force required to close adjacent portions of the zipper.

3. A zipper as defined in claim 1, wherein a part of the rib profile is segmented and the groove profile is of a single material.

4. A zipper as defined in claim 1, wherein the rib profile is of a single material and the groove profile is segmented.

5. A zipper as defined in claim 1, wherein opposing interlockable parts of both the rib and groove profile are segmented.

6. A zipper as defined in claim 1, wherein the rib and groove profiles each are of a longitudinally consistent cross-section in terms both of size and configuration.

7. A reclosable thermoplastic bag having the zipper of any of claim 1 or 4-6 about an opening thereof.

* * * * *